US006066996A

United States Patent [19]

Goertz et al.

[11] Patent Number: 6,066,996

[45] **Date of Patent: *May 23, 2000**

[54] MICROWAVE FILTER WITH MEANS FOR COUPLING DEGENERATE MODES

[75] Inventors: Franz-Josef Goertz, Burgstetten; Uwe Rosenberg, Aspach; Dietmar Schmitt, Kleinaspach, all of Germany

[73] Assignee: Robert Bosch GmbH, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/654,032

[22] Filed: May 28, 1996

[30] Foreign Application Priority Data

Jun. 27, 1995 [DE] Germany ..... 195 23 220

[51] Int. Cl.[7] ..... H01P 1/208

[52] U.S. Cl. ..... 333/202; 333/212; 333/99.005

[58] Field of Search ..... 333/202, 212, 333/202 DR, 995

[56] References Cited

U.S. PATENT DOCUMENTS

| | | | |
|---|---|---|---|
| 2,795,763 | 6/1957 | Tillotson | 333/208 |
| 4,734,665 | 3/1988 | Rosenberg et al. | 333/212 |
| 4,760,361 | 7/1988 | Kobayashi | 333/212 X |
| 4,772,863 | 9/1988 | Rosenberg et al. | 333/212 |
| 5,083,102 | 1/1992 | Zaki | 333/202 X |
| 5,498,171 | 3/1996 | Mansoor et al. | 333/202 X |

*Primary Examiner*—Benny Lee
*Attorney, Agent, or Firm*—Michael J. Striker

[57] ABSTRACT

A microwave filter has at least two resonators, with at least two degenerated wave types resonance-capable in one resonator. The resonators are in operative connection with one another so that possible couplings of the degenerated wave types are only overcouplings and these overcouplings are located outside the resonator in which the two degenerated wave types are resonance-capable. As a result, the microwave filter has higher quality, improved selection properties and optimal polarization adapation.

9 Claims, 3 Drawing Sheets

MICROWAVE FILTER WITH MEANS FOR COUPLING DEGENERATE MODES

BACKGROUND OF THE INVENTION

The present invention relates to a microwave filter including at least two resonators, in which at least two degenerated wave types capable of resonance are provided in one of the resonators.

Such microwave filters are disclosed, for example, in IEEE MTT Volume 20, No. 15, April 1972, pages 258–265; IEEE MTT-32, No 11, November 1984, pages 1439–1454, or also in U.S. Pat. Nos. 3,697,898; 4,513,264 or 4,792,771. Such filters are characterized in that, several wave types are used simultaneously. In the above mentioned cases, the degenerated wave types are coupled in each resonator with one another, and the coupling is performed in correspondence with the main signal path (main coupling path). In other words, the wave types located in each resonator form electrically adjacent resonance circuits. In the case of the filter structure disclosed in the IEEE MTT, Volume 25, No. 12, December 1977, pages 1021–1026, the filter structure deals with a canonic form in which a main coupling between the wave types of a short-circuiting resonator is performed, while the coupling of the wave types inside the other resonator serves for overcoupling [transverse coupling] per each integral number of the resonance circuits.

SUMMARY OF THE INVENTION

Accordingly, it is an object of the present invention to provide a microwave filter in which new filter structures are realized in a simple manner.

In keeping with these objects and with others which will become apparent hereinafter, one feature of the present invention resides, briefly stated in a microwave filter which has at least two resonators, a first one of the resonators has at least two degenerated wave types which are capable of resonance, a working connection is provided between the resonators so that an energy transfer from one degenerated wave type which is capable of resonance in the first resonator to the other degenerated wave type which is also capable of resonance occurs substantially outside the first resonator, and the possible couplings of the degenerated wave types with one another are overcouplings.

In the filter structure known from the prior art which also use the degenerated wave types inside the resonators, at least in one resonator a coupling is needed for degenerated wave types located in this resonator. When the wave filter is designed in accordance with the present invention, such a coupling of degenerated wave types is no longer performed inside of the resonators. With the use of different wave types, in particular, with a combination of multi (e.g. dual, triple) mode resonators with single-mode resonators having a high quality, a lower insertion damping than with a filter can be obtained, which can be utilized for all circuits of the same wave type. By the realization of other wave types and the resonator shapes, further preferable configurations are obtained which under certain conditions can have better selection properties due to the utilization of different wave types. For example, the polarization can be optimally adapted to the inlet and outlet interface. Moreover, in such a filter, the compensation expenses are reduced, since the coupling means for coupling the degenerated wave types can be dispensed with, which during compensation determine the wave types. The microwave filter, in accordance with the present invention, can be combined with known resonators having a conventional coupling mechanism in a simple manner to form complex filter structures. The microwave filter in accordance with the present invention is actually composed of at least two adjacent resonators, and in at least one resonator, two degenerated resonance wave types are provided capable of resonance, which are not directly adjacent electrically in the main coupling path. In the main coupling path between the resonance wave types, the possible degenerated wave types are coupled with one another inside the other resonators. The microwave filter in accordance with the present invention can be assembled from hollow space resonators, dielectric resonators, or coaxial resonators as well as some combination of these resonators.

The novel features which are considered as characteristic for the present invention are set forth in particular in the appended claims. The invention itself, however, both as to its constructions and its methods of operation, together with additional objects and advantages thereof, will be best understood from the following description of specific embodiments when read in connection with the accompanying drawings.

DESCRIPTION OF THE PREFERRED EMBODIMENTS

Figure 1:
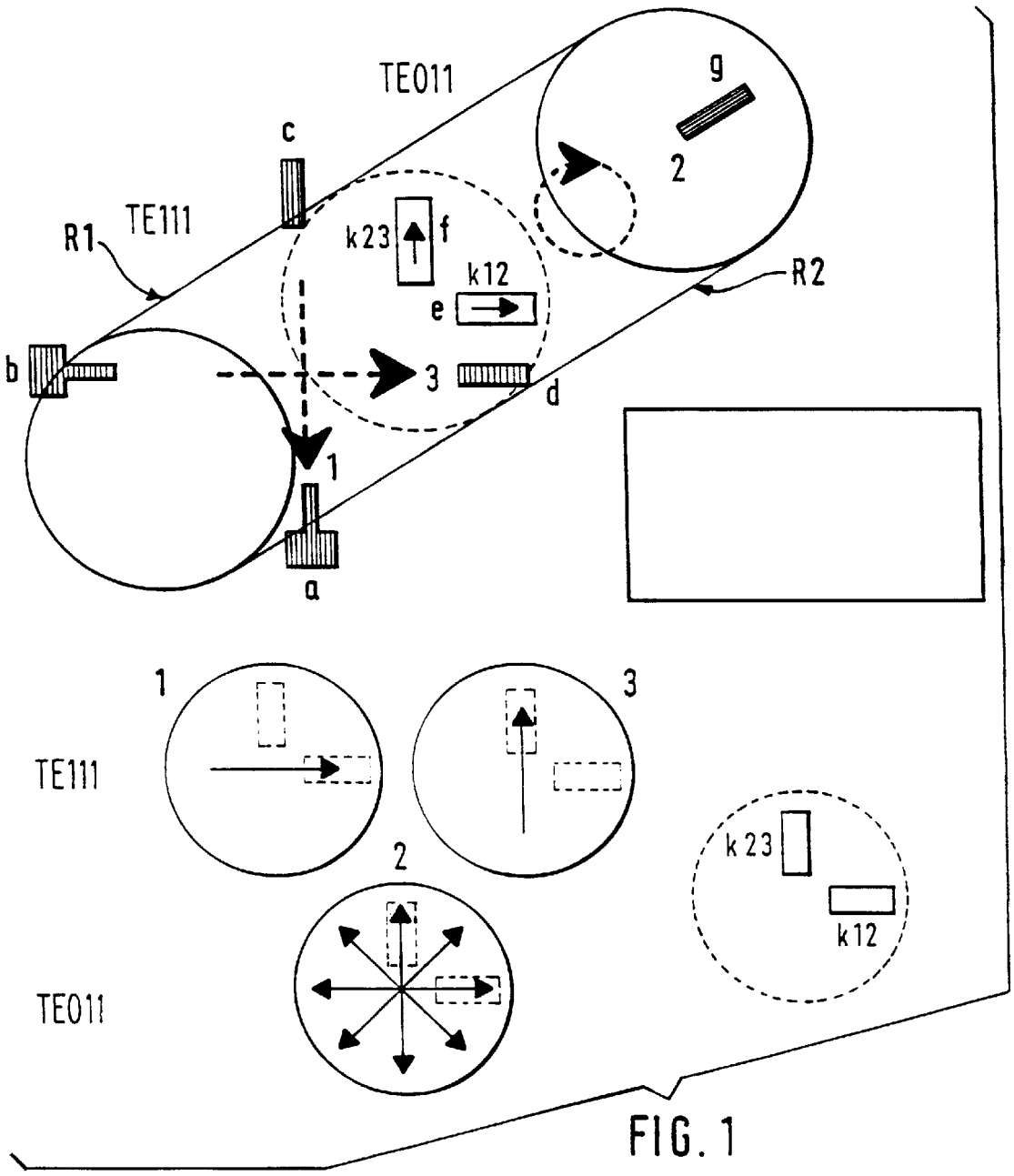
FIG. 1 is a view showing a three-circuit filter with a position of diaphragms and field vectors in accordance with one embodiment of the present invention.

One embodiment of the present invention is shown in FIG. 1 and illustrates a three-circuit filter. The filter has two cylinder resonators arranged coaxially. A coupling "b" which is arranged relative to a coupling "a" at 90° is located at the first resonator R1. Two degenerated uncoupled wave types $TE_{111}$ (dual mode) are resonance-capable in this resonator. Frequency determining elements "c" and "d" are shown symbolically. A diaphragm for the magnetic coupling with openings "e" and "f" is located in a separating wall between both resonators. The openings "e" and "f" are formed as radial slots which extend perpendicular relative to one another and substantially from the cylinder outer wall in direction towards the center to provide main couplings k12 and k23, respectively.

The $TE_{011}$ wave type (single mode) is resonance-capable in the second resonator R2 and is compensated by the frequency determining element g. The $TE_{011}$ wave type has parallel field components in the diaphragm plane both for the first as well as for the second $TE_{111}$ wave type of the first resonator. Due to the position and size of the coupling openings "e" and "f" in the diaphragm, a magnetic coupling of the circuit can be performed, for example, in the following manner.

The mode 1 in the first resonator R1 is coupled to the single mode 2 in the second resonator R2 through the diaphragm slot "e". The single mode couples to the mode 3 in the first resonator R1 through the diaphragm slot "f". In this manner, a main coupling path 1-2-3 is produced.

The resonators R1 and R2 are in an operative connection with one another, such that an energy transfer from the resonance-capable first degenerated wave type in the first resonator R1 to a second resonance-capable degenerated wave type in it is performed outside the first resonator R1, and the possible couplings of this degenerated wave types with one another are overcouplings.

Figure 2:
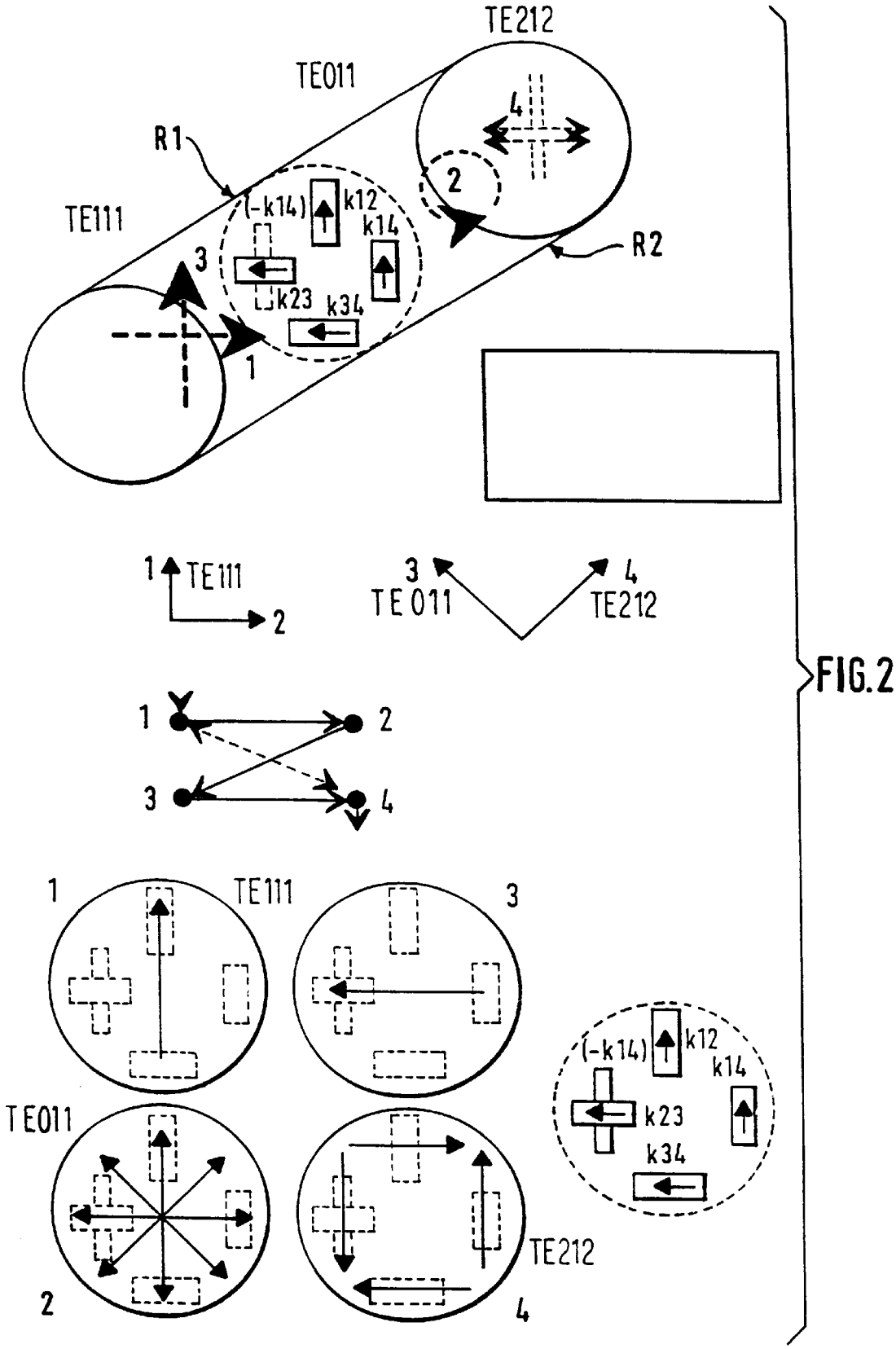
FIG. 2 is a view showing a four-circuit Cauer filter with a position of the diaphragms and field vectors in accordance with another embodiment of the present invention.

The second embodiment of the microwave filter in accordance with the present invention shown in FIG. 2 is a four-circuit Cauer filter. It has two hollow space resonators which are utilized in dual-mode operation. Both degenerated $TE_{111}$ wave types (mode 1 and 3) must be resonance-capable in the first resonator R1, and in the second resonator R2 the degenerated $TE_{011}$ (mode 2) and $TE_{212}$ (mode 4) wave types are resonance-capable. The specifics of this filter is that the different wave types are resonance-capable in the resonators, which are not coupled inside the resonators.

In this example, the magnetic couplings are realized exclusively by diaphragms. It should be noted that here a substantially independent diaphragm design is possible for the main couplings k12, k23, and k34 and a positive or negative auxiliary (cross) coupling k14.

The diaphragm openings for each corresponding coupling are positioned so that the undesired couplings are supressed by orthogonal or identically dimensioned opposite field components of other wave types in the region of the corresponding coupling openings. Thus, for example, the modes 2 and 3 inside the coupling opening k23 have only orthogonal field components to the modes 1 and 4. The modes 3 and 4 have in the coupling opening k34 field components which are orthogonal to the mode 1 and identically dimensioned opposite or orthogonal field components to the mode 2.

Figure 3:
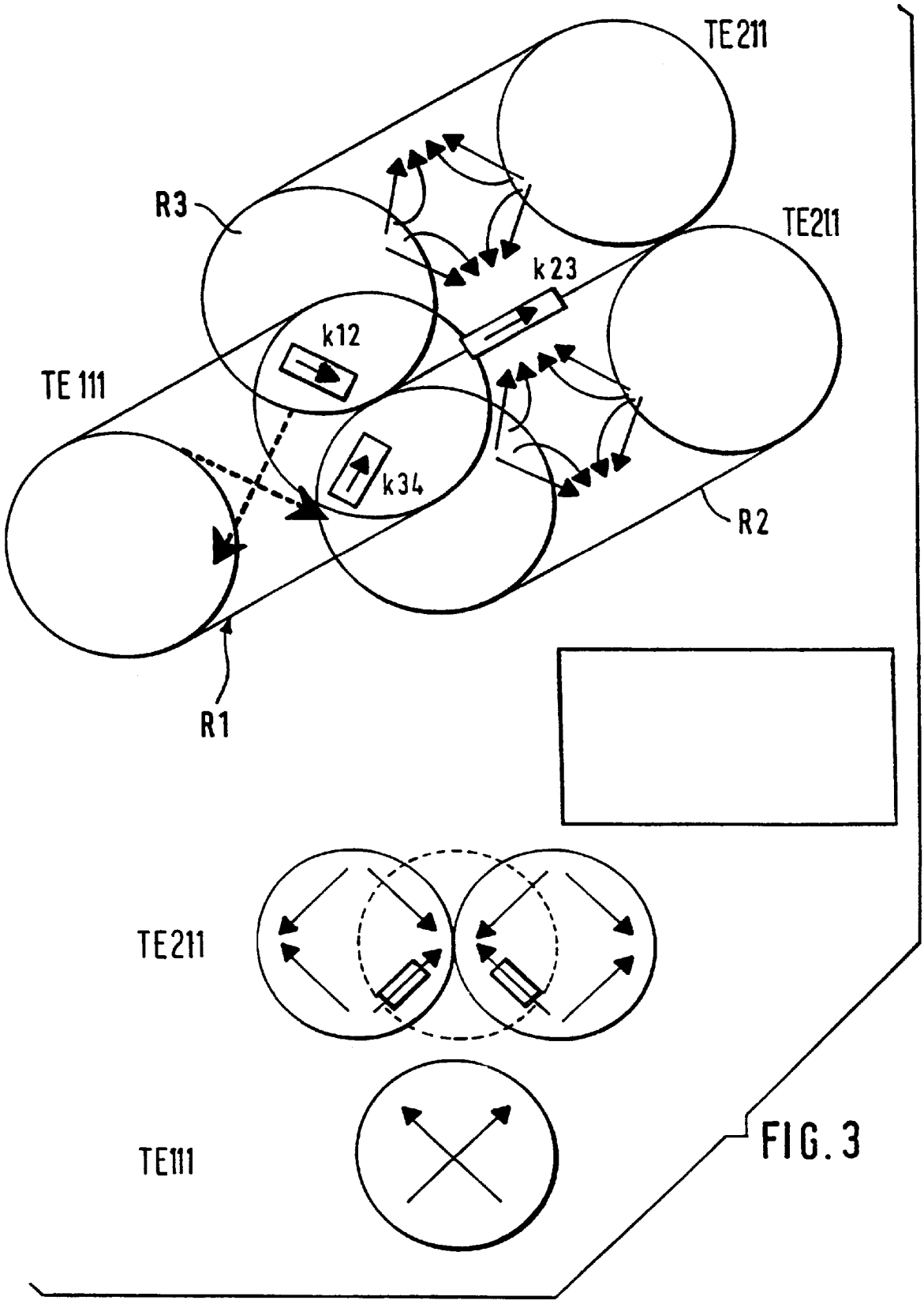
FIG. 3 is a view showing a four-circuit filter with three resonators in accordance with a further embodiment of the present invention.

FIG. 3 shows an embodiment example of a four-circuit filter which is provided with three resonators. The first resonator R1 operates in the dual mode ($TE_{111}$) and both other R2, R3 resonators operate in the single mode ($TE_{211}$). Magnetic couplings k12, k23, k34 are realized by respective diaphragms. It should be mentioned with the drawings illustrate only the basic principle of the invention. The different wave types naturally correspond to different dimensions of the resonators, and in particular the shown cylindrical hollow space resonators can have different diameters.

In addition to the shown wave-type combinations, also other combinations are possible which operate in accordance with the principle of the present invention, for example, triple-dual-mode resonators. The microwave filter in accordance with the present invention can be provided with hollow conductor resonators. Dielectric resonators, coaxial resonators or resonators using the super conductors, as well as combinations of the above.

Instead of the magnetic coupling of the resonator, also capacitive couplings or combinations of magnetic and capacitive couplings can be utilized as well. In all cases only the main principle must be maintained in that, the possible couplings of the degenerated wave types with one another are substantially overcouplings. Normally it is recommended to provide exclusively overcouplings for the coupling of the degenerated wave types. In other words, the degenerated wave types are not coupled with one another through main couplings.

It will be understood that each of the elements described above, or two or more together, may also find a useful application in other types of constructions differing from the types described above.

While the invention has been illustrated and described as embodied in microwave filters, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

We claim:

1. A microwave filter, comprising at least two resonators including a first resonator and a second resonator, said first resonator being provided with at least two degenerated wave types capable of resonance, said second resonator being provided with at least one degenerated wave type, which is different from said at least two degenerated wave types capable of resonance in the first resonator, said first and second resonators being in an operative connection such that energy transfer from one of said at least two degenerated wave type which is resonance-capable in said first resonator to the at least one resonance-capable wave type in said second resonator and back to the other one of the at least two degenerated wave types which is resonance-capable in said first resonator is performed outside said first resonator.

2. A microwave filter as defined in claim 1, wherein said first resonator is operative in a dual mode, said second resonator which is electrically adjacent to said first resonator being operative in a single mode.

3. A microwave filter as defined in claim 1, wherein each of said first resonator and said second resonator is operative in a dual mode.

4. A microwave filter as defined in claim 1, and further comprising at least one third resonator provided with at least one further degenerated wave type which is different from the at least two degenerated wave types capable of resonance in the first resonator, said third resonator being in operative connection with said first and second resonators such that said energy transfer from the degenerated wave type which is resonance-capable in the second resonator and back to the other one of the at least one degenerated wave types which is resonance capable in the first resonator is performed through said third resonator which is located outside said first resonator.

5. A microwave filter as defined in claim 1, and further comprising coupling and decoupling means, said coupling and decoupling means being provided only in one of said at least two resonators and being arranged relative to one another at 90°.

6. A microwave filter as defined in claim 1, wherein said at least two degenertated wave types in said first resonator are coupled with on another.

7. A microwave filter as defined in claim 1; and further comprising additional resonators combined with said first and second resonators.

8. A microwave filter as defined in claim 1, wherein said at least two resonators are comprised of hollow space resonators.

9. A microwave filter as defined in claim 1, wherein said at least two resonators have respective walls provided with corresponding diaphragms and are magnetically coupled with one another through said corresponding diaphragms.

* * * * *